US005464073A

United States Patent [19]

Johannes

[11] Patent Number: 5,464,073

[45] Date of Patent: Nov. 7, 1995

[54] DEVICE FOR REMOVING THE RUBBISH GATHERING IN THE THRESHOLD OF AN ELEVATOR CAR

[75] Inventor: de Jong Johannes, Järvenpää, Finland

[73] Assignee: Kone Oy, Helsinki, Finland

[21] Appl. No.: 166,006

[22] Filed: Dec. 14, 1993

[30] Foreign Application Priority Data

Dec. 22, 1992 [FI] Finland ..... 925839

[51] Int. Cl.[6] ..... B66B 13/00

[52] U.S. Cl. ..... 187/334; 49/410

[58] Field of Search ..... 187/56, 51, 1 R, 187/313, 334, 333; 49/410, 116, 120

[56] References Cited

U.S. PATENT DOCUMENTS 4,781,270 11/1988 Holland ..... 187/56

FOREIGN PATENT DOCUMENTS 3-018592 1/1991 Japan .
3-152086 6/1991 Japan .
4140295 5/1992 Japan .
5-078071 3/1993 Japan .

*Primary Examiner*—Kenneth Noland

[57] ABSTRACT

A device for the removal of rubbish gathered in the threshold of an elevator car, the threshold being provided with one or more holes below the bottom guide of the elevator car door. Below the one or more holes there is a rubbish collecting container or bag, in which the rubbish coming through the holes in the threshold is collected.

9 Claims, 1 Drawing Sheet

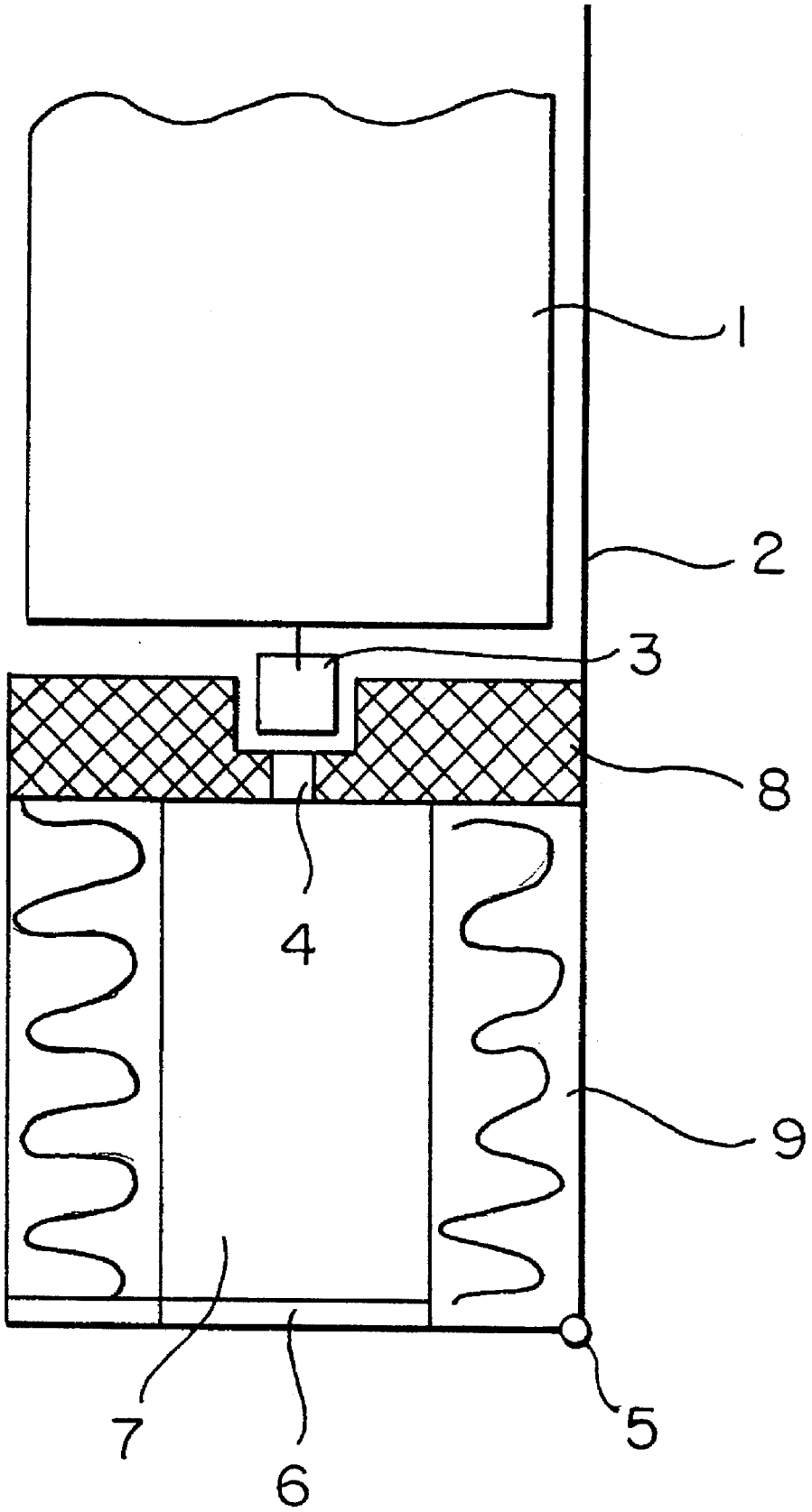
1
2
3
8
4
9
7
6
5

DEVICE FOR REMOVING THE RUBBISH GATHERING IN THE THRESHOLD OF AN ELEVATOR CAR

The present invention relates to a device according to the introductory part of claim 1 for removing the rubbish gathering in the threshold of an elevator car.

In many elevators, the rubbish gathered in the threshold causes problems in the operation of the doors. The threshold rail is provided with holes through which the rubbish is expected to fall down into the shaft, from where it is cleared away at certain intervals. Large lumps of rubbish may also damage the doors. The falling rubbish may get into the space between the landing doors below, producing noise or disturbances in the door operation. As the car is moving downwards, the air is forced through the rubbish holes, which, especially in the case of fast elevators, may generate a hissing or a turbulence-type noise. Also, any other kinds of noise produced by the elevator propagate into the the shaft through these holes.

The object of the present invention is to eliminate the drawbacks mentioned above. The rubbish collecting container of the invention, mounted below the bottom guide of the elevator door, is characterized by what is presented in the characterization part of claim 1. The other preferred embodiments of the invention are characterized by what is presented in the other claims.

The invention provides the following advantages:

rubbish is not allowed to fall into the shaft but is collected in a container improves the sound insulation of the car air flow can be reduced through appropriate design reliable door operation eliminates disturbances in the operation of landing doors In the following, the invention is described by the aid of an example by referring to the attached drawing, in which FIG. 1 presents a rubbish collecting container according to the invention.

FIG. 1 shows the rubbish collecting container 7 of the invention in lateral view. The rubbish collecting container 7 is placed below the bottom guide 3 of the elevator door 1. The front wall of the elevator car is designated by reference number 2. The threshold 8 of the elevator car forms the top part of the container, or the container may be a separate box attaced to the threshold. It may also be a part of the toe guard structure. The walls are made of an insulating material 9, so this container can also be used to improve the sound insulation. One of the walls can be made longer than the other and they can be made of sheet metal or other material sustaining a load, which can be lined with an insulating material 9 to increase the damping efficiency of the structure against external noise. The rubbish collecting container 7 is made as tight as possible so that it can also be used as an air flow guide. The size and shape of the rubbish collecting container 7 can be selected according to the circumstances. Its bottom is provided with a lid 6 with hinges 5, through which the rubbish can be removed. This lid can also be fastened in some other way, e.g. by means of bolts, studs, tape etc. The rubbish falls into the container through the holes 4 in the lower part of the bottom guide 3 of the car door

1. The rubbish collecting container 7 may also be implemented without a lid, in which case the whole container can be removed for emptying. Instead of a rubbish collecting container 7, it is also possbile to use a rubbish collecting bag, which may disposable or emptied at times and preformed as required. The inside of the bag can be lined with a sound insulating material.

It is obvious to a person skilled in the art that different embodiments of the invention are not restricted to the examples amples described above, but that they may instead be varied within the scope of the following claims. The rubbish collecting container may have a different form and the opening for rubbish removal can be located at a place other than the bottom.

I claim:

1. A device for removal of rubbish gathered in a threshold of an elevator car, said threshold being provided with one or more holes below a bottom guide of an elevator car door, the device comprising:

a rubbish collecting container fully enclosed on all sides and having an aperture on one side thereof, the aperture positioned below the one or more holes, in which the rubbish coming through the holes in the threshold passes through the aperture and is collected in the container.

2. A device according to claim 1, wherein:

the rubbish collecting container is lined with a sound insulating material.

3. A device according to claim 1, wherein:

the rubbish collecting container has an outlet opening provided with a lid for removal of the rubbish.

4. A device according to claim 1, wherein:

the rubbish collecting container is formed such that it also acts as an air flow guide preventing air from being forced through the aperture and then through the one or more holes of the threshold into an interior of the elevator car during a vertical motion of the car.

5. A device according to claim 1, wherein:

a top part of the rubbish collecting container is formed by the threshold of the elevator car.

6. A device according to claim 1, wherein:

the rubbish collecting container is part of a toe guard structure.

7. A device as in claim 1, wherein:

the rubbish collecting container is a bag.

8. A device as in claim 1, further comprising:

lid means for selectively opening and closing the container.

9. A device for removal of rubbish gathered in a threshold of an elevator car, said threshold being provided with one or more holes below a bottom guide of an elevator car door, comprising:

a rubbish collecting container or bag, in which the rubbish coming through the holes in the threshold is collected;

wherein the rubbish collecting container or bag is lined with a sound insulating material.

* * * * *